United States Patent [19]

Personnet et al.

[11] Patent Number: 4,702,820

[45] Date of Patent: Oct. 27, 1987

[54] PRETREATMENT BY ALKALINE WETTING AND HOLDING AT TEMPERATURE OF NATURAL MATERIALS HAVING AN ARGILLACEOUS GANGUE CONTAINING COMBUSTIBLE ELEMENTS

[75] Inventors: Pierre-Bernard Personnet, Aix-en-Provence; Jean-Michel Philbert, St. Leu la Foret, both of France

[73] Assignee: Uranium Pechiney, France

[21] Appl. No.: 894,519

[22] Filed: Aug. 8, 1986

Related U.S. Application Data

[63] Continuation of Ser. No. 673,196, Nov. 19, 1984, abandoned.

[30] Foreign Application Priority Data

Nov. 23, 1983 [FR] France ..... 83 19064

[51] Int. Cl.[4] ..... C10G 1/06; C10G 1/00

[52] U.S. Cl. ..... 208/424; 208/390; 208/391; 208/403; 208/42 P; 208/430

[58] Field of Search ..... 208/390, 391, 403, 424, 208/428, 430

[56] References Cited

U.S. PATENT DOCUMENTS

| | | | |
|---|---|---|---|
| 2,202,901 | 6/1940 | Dreyfus | 208/8 LE |
| 4,159,240 | 6/1979 | Malek | 208/8 LE |
| 4,167,397 | 9/1979 | Grant | 44/1 SR |
| 4,222,849 | 9/1980 | Shimizu | 208/8 LE |
| 4,234,319 | 11/1980 | Beeson | 44/1 R |
| 4,409,091 | 10/1983 | Kessick | 208/11 LE |

FOREIGN PATENT DOCUMENTS

| | | | |
|---|---|---|---|
| 0639098 | 3/1967 | Canada | 208/11 LE |
| 1012083 | 6/1977 | Canada | 208/11 LE |
| 54-126203 | 1/1979 | Japan | 208/8 LE |

*Primary Examiner*—Andrew Metz
*Assistant Examiner*—William G. Wright
*Attorney, Agent, or Firm*—Jones, Day, Reavis & Pogue

[57] ABSTRACT

Process for pretreatment at atmospheric pressure or a pressure close to atmospheric pressure by alkaline wetting and holding at temperature of natural materials whose gangue comprises argillaceous compounds capable of forming a stable plastic suspension in the presence of water and containing at least one combustible element which can be put into useful form wherein, in order to permit subsequent easy operations for separation of the liquid aqueous and solid phases of the gangue:

(a) the natural material which was possibly been subjected to a preliminary drying operation is brought into intimate contact with at least 4 kg expressed in terms of $OH^-$ of at least one alkaline agent per ton of clay contained in said material, the total volume of liquid present in the natural material after the contacting operation being such that the ratio L/S of said volume expressed in terms of cubic meters to the weight of solid expressed in tons of dry ore is at most equal to 0.6; and (b) the natural material when wetted in that way is subjected to a pretreatment temperature that is suited to the nature of the combustible element and which is at most equal to 150° C., for a period of time of at least 30 minutes.

11 Claims, No Drawings

PRETREATMENT BY ALKALINE WETTING AND HOLDING AT TEMPERATURE OF NATURAL MATERIALS HAVING AN ARGILLACEOUS GANGUE CONTAINING COMBUSTIBLE ELEMENTS

This application is a continuation of application Ser. No. 673,196, filed Nov. 19, 1984, and now abandoned.

The invention concerns a process for pretreatment at atmospheric pressure or a pressure which is close to atmospheric pressure by alkaline wetting and holding at a suitable temperature of natural materials whose gangue comprises argillaceous compounds which are capable of forming a stable plastic suspension in the presence of water and containing at least one combustible element which can be put into useful form such as for example coal, lignite, petroleum, bitumen or peat.

The applicants use the expression "pretreatment" to define a treatment prior to a valorisation operation permitting extraction of the combustible element or elements, of the natural material, which can be put into useful form, the purpose of the pretreatment being subsequently to impart to the argillaceous gangue, in the presence of a liquid phase, an aptitude for separation of the two phases.

It has already long been known to the man skilled in the art that argillaceous compounds forming the gangue of certain combustible elements (which it would be desirable to exploit) have a real propensity to swell, then to split and finally to disperse in the form of fine crystals and small agglomerates, upon contact with an aqueous phase. When that phenomenon occurs in the course of the phases involved in putting the combustible elements into a usable form, in an aqueous medium, that is to say, in the course of separation of the combustible material and its gangue, it makes it very difficult to provide for separation of the liquid aqueous and solid phases on the fine fractions of the gangue subsequently to extraction of the combustible material which is to be put into useful form, making the suspension produced unsuited to settling and to filtration, by virtue of the swelling action of the clays.

The argillaceous compounds which are capable of forming a stable plastic suspension upon contact with water, which are frequently present in the natural materials having an argillaceous gangue as referred to above, may belong to the groups formed by kaolinites such as for example kaolinite, dickite, halloysite, irregular kaolinites and serpentines; the group of micas such as for example muscovite, biotite and paragonite, pyrophyllite and talc, illites and glauconite; the montmorillonites group such as for example beidellite, stevensite, saponite and hectorite; the chlorites group; the vermiculites group; the group of interstratified clays whose unitary structure is a combination of the foregoing groups; the group of fibrous clays such as for example attapulgite (palygorskite) and sepiolite. The above-indicated argillaceous gangue-bearing natural materials may also contain other compounds such as for example quartz, calcite ($CaCO_3$), dolomite, gypsum and certain schists having various degrees of metamorphism.

Many processes for making use of combustible elements contained in a gangue which is non-argillaceous or slightly argillaceous are well known to the man skilled in the art, as is the difficulty of transferring such processes for use on combustible elements having a gangue which is clearly argillaceous.

In fact, such processes may give rise to very substantial settling surface areas when the argillaceous phase is in the presence of water, at the end of the operation for putting such elements into a useful form. In addition, in some cases, the clays present may also give rise to a higher level of consumption of reactants such as those intended for the flotation operation, extraction by means of solvents or separation in a dense medium.

A first type of drawback appears in the publication "Hydrocarbon Processing", pages 127 to 130, June 1981, from the Standard Oil Co which describes a process for treating bituminous sands, with a gangue which is more or less argillaceous, requiring an amount of water which increases in proportion to the amount of argillaceous gangue. In fact, that process involves treating the bituminous sands by means of an aqueous solution of sodium carbonate at a temperature of 70° C. to reduce the viscosity of the bitumen, then effecting extraction of the bitumen by means of an organic solvent, and finally recovering the water which is intended to be recycled in the course of an operation of separating the liquid and solid phases, which is carried out on the mineral phase which has not been put into solution by the solvent. However, applying such a process to a bituminous sand with a high proportion of clay gives rise to difficulty in the final separation of the liquid aqueous and solid mineral phases, which, as clearly indicated, gives rise to a higher level of water consumption.

Another type of disadvantage appears when applying the well-known processes for treating coals or lignites when those fuels are associated with an argillaceous gangue.

A well-known process of that kind, which is described in the "Encyclopedia of Chemical Technology" by Kirk-Othmer, 3rd edition, volume 6, pages 266–267, comprises separating the combustible material from its gangue by a treatment in a dense medium or in a pulsated aqueous medium.

The products resulting from the separation operation are on the one hand the combustible material from which the aqueous phase has been removed by a draining operation and on the other hand the gangue which is itself subsequently separated from its aqueous phase by settling, the surface areas required for carrying out the settling operation increasing in proportion to an increasingly argillaceous gangue.

Modes of operation of that kind, which are found to be an attractive proposition for putting certain combustible elements into a usable form are difficult to apply when the situation involves making use of combustible elements whose gangue is formed, inter alia, by argillaceous compounds, as while the application of such a process to a natural material having an argillaceous gangue does result in correct enrichment of the combustible material which is to be put to use, it also results in the formation of a suspension of gangue resulting from the treatment, in respect of which it is difficult to provide for separation of the liquid and solid phases, irrespective of the amount of flocculating agents added, by virtue of its being unfilterable and even difficult to cause to settle.

Hence, having regard to the foregoing disadvantages, the applicants, continuing their research, found and developed a process for pretreatment of natural materials having an argillaceous gangue, containing at least one combustible element which can be put into useful form.

The process according to the invention for the pretreatment of natural materials containing at least one combustible element, which is carried out at atmospheric pressure or a pressure close to atmospheric pressure, comprising alkaline wetting of the material and holding same at a temperature which is suited to the nature of the combustible element to be put into useful form, the gangue of which comprises argillaceous compounds which are capable of forming a stable plastic suspension in the presence of water is characterised in that, in order to permit easy subsequent separation operations in respect of the liquid aqueous and solid phases to be carried out on the argillaceous gangue:

(a) the natural material is brought into intimate contact with at least 4 kg expressed in respect of $OH^-$ of at least one alkaline agent per tonne of clay contained in said natural material, (b) the natural material when wetted in that way is subjected to a pretreatment temperature which is suited to the nature of the combustible element and which is at most equal to 150° C., for a period of at least 30 minutes.

The term "wetted" denotes the result of bringing the natural material into contact with the alkaline agent, whether that agent is in solid form or in the form of an aqueous solution.

As already stated, the natural materials containing at least one combustible element whose gangue is formed at least in part by argillaceous compounds are difficult to put into a useful form by conventional treatment processes as the suspension of gangue resulting from such treatment operations becomes unsuited to separation of the liquid aqueous and solid phases, both by means of filtration and by means of settling, since it becomes plastic and stable upon coming into contact with water.

Such natural materials containing at least one combustible element with an argillaceous gangue may thus be doomed not to be exploited, even when they are rich in combustible elements which can be put into useful form, or else they are exploited by means of specific treatment operations which are complex and costly.

The process according to the invention aims to restore to the man skilled in the art natural materials having an argillaceous gangue, containing at least one combustible element which is to be put into useful form, which are deemed to be difficult to put to use by means of conventional treatment processes, in consideration of the physical consequences referred to hereinbefore, the process comprising subjecting the natural materials to a simple and inexpensive alkaline pretreatment prior to the treatment for putting the elements into a useful form, by means of which pretreatment the suspension of gangue resulting from said treatment operations becomes suitable for easy separation of the liquid aqueous and solid phases by filtration and/or settlement.

In general, the natural materials containing at least one combustible material which can be made use of, are subject as they are to the pretreatment operation according to the invention.

However, it may happen that the natural materials have an amount of water such that the solid particles have a tendency to give rise to agglomerates which prevent a satisfactory flow of such particles, that flow being required in order to provide for intimate wetting in accordance with the pretreatment operation of the invention. In that case, the material is subjected to preliminary drying.

The alkaline pretreatment agent according to the invention may be introduced in a solid form or in the form of an aqueous suspension or a solution.

When the alkaline agent is introduced in aqueous form, it may be the result of a preparation operation by dissolving or dispersing hydroxide in a natural or possibly briny water or by dissolving or dispersing same in a process water resulting for example from a treatment which is downstream of the pretreatment operation according to the invention, which process water may contain as varied chemical compounds as for example NaCl, $Na_2SO_4$, $Na_2CO_3$, $Ca(HCO_3)_2$.

That agent is such that, when it is brought into contact with water, it frees $OH^-$ ions. The alkaline agent may be selected from the group formed by alkali metal or equivalent and/or alkaline earth hydroxides and preferably from hydroxides of sodium, potassium and ammonium, as well as calcium hydroxide.

Depending on the nature of the gangue of the combustible element, the alkaline agent may be formed by a single hydroxide such as sodium hydroxide or by a mixture of at least two hydroxides such as for example sodium and calcium hydroxides.

Likewise, depending on the nature of the gangue of the combustible element, the amount of alkaline agent which is brought into intimate contact with the natural material to produce the alkaline wetting effect is at least 4 kg expressed in respect of $OH^-$ per tonne of clay contained in said material. More generally, the amount of alkaline agent expressed in respect of $OH^-$ may be selected to fall within the range of from 4 to 100 kg per tonne of clay contained in the natural material and preferably may be selected to fall in the range of from 10 to 90 kg per tonne of clay contained in said material.

The natural material containing at least one combustible element is brought into contact with the alkaline agent, thus forming the pretreatment medium which occurs in the form of a phase which is wetted by said agent, the physical state of which may vary from the solid to the pasty, depending on whether the alkaline agent is introduced in solid form or in the form of an aqueous suspension or a solution.

At the same time as the alkaline agent is introduced, it may be found that it is useful for the mixture to be subjected to working, in order to promote good distribution thereof within the natural material.

Taking into consideration not only the water which may be introduced when the alkaline agent is used in the form of an aqueous solution but in particular the water which is initially present in the natural material containing at least one combustible element, that is to say, taking account of the total amount of water present in the medium after the wetting operation, the ratio of the liquid phase expressed in terms of cubic meters to the solid phase expressed in terms of tonnes of dry natural material (L/S) is always at most equal to 0.6, is generally between 0.05 and 0.5 and is preferably between 0.1 and 0.4.

In practice, the ratio L/S of the liquid phase present, expressed in terms of cubic meters, to the solid phase, expressed in terms of tonnes of dry natural material, increases in proportion to an increasing clay content in the material which is subjected to the pretreatment operation, so as to produce a moist paste which is neither fluid nor sticky.

Once the natural material is in intimate contact with the alkaline agent, the wetted medium is then subjected to the pretreatment temperature of at most 150° C. The pretreatment temperature which is always suited to the nature of the combustible element may generally be selected to fall in the wide range of from 15° C. to 150° C. for natural materials containing at least one combustible element such as coal or lignite and may preferably be selected to fall in the range of from 15° C. to 90° C. for the natural materials which contain at least one combustible element such as bitumen or petroleum.

The duration of the pretreatment operation is generally greater than 30 minutes, the length thereof being greater as the temperature is lower.

In accordance with a particular arrangement, it may be an attractive proposition to carry out the pretreatment operation in a reducing medium, using suitable known agents.

During the pretreatment according to the invention, the medium wetted by the alkaline agent may be subjected to minimum mechanical agitation.

In another particular form, it may be desirable to carry out a carbonation step after the pretreatment, to restore the pH of the medium resulting from the pretreatment step to a value compatible with the subsequent valorisation treatments.

By virtue of the pretreatment process according to the invention, the phenomenon of splitting of the clays, which occurs in the presence of an aqueous phase, is virtually irreversibly inhibited, whereby it is possible subsequently and at any suitable moment to carry out any subsequent treatment for putting the material into useful form, such as for example flotation, separation in a dense medium, or gravimetric separation of the pretreated argillaceous gangue-bearing combustible element, which may readily include agitation, storage, transfer and separation steps.

In addition, the treatment process according to the invention does not subsequently give rise to a limitation in regard to the yields achieved in putting the combustible element into a useful form, irrespective of the type of treatment carried out, in an aqueous medium.

Finally, in order to facilitate separation of the liquid aqueous and solid phases of the suspension of gangue resulting from the pretreatment process according to the invention, it is desirable to introduce a flocculating agent in a dilute aqueous solution, the concentration thereof generally being at most equal to one gram per liter, using quantities which do not exceed 500 grams per tonne of natural material, but are always adapted to the desired results.

The advantages of the process according to the invention will be more clearly apparent by reference to the example given by way of illustration.

EXAMPLE

This example illustrates the good influence of the pretreatment operation according to the invention on a bituminous sand having a highly argillaceous gangue.

For that purpose, use was made of a bituminous sand having an argillaceous gangue, of the following composition in percent by weight:

Silica: 59.9
including quartz: 42.8
$Al_2O_3$: 10.8
CaQ: 1.7
$Na_2O$: 1.3
$K_2O$: 1.9
Bitumen: 12.8
Bonding $H_2O$ and various: 11.6.

The clays essentially comprised montmorillonite and illite. The clay content was close to 40%.

In a first test which illustrates the prior art, 100 g of the argillaceous gangue-bearing bituminous sand was put into suspension in 250 g of an agitated solution of $Na_2CO_3$, at a concentration such that the final pH-value of the suspension prepared in that way was 8.6.

The temperature of the prepared suspension was 78° C. The medium, while being maintained at that temperature, was subjected to mechanical agitation for a period of 12 minutes.

20 g of kerosine was then introduced into the agitated hot medium in order to extract the bitumen present.

After a rest period of 5 minutes, for promoting separation of the organic and aqueous phases by settling, the organic phase was collected in the upper part. Then, in order to simulate recycling of the aqueous phase to the upstream part of an industrial process, the attempt ws made to effect separation of the sandy and argillaceous gangue from the aqueous phase, by filtration. For that purpose, separation was carried out on a Büchner filter subjected to a vacuum of 500 millimeters of mercury, with the speed of separation of the liquid phase being measured in cubic meter.hour$^{-1}$.meter.$^{-2}$.

Before the suspension was passed over the filter, the suspension had added thereto a flocculating agent in a proportion of 20 milliliters of a 0.5 g/l solution of Floerger FA 10 prepared from a 2.5 g/l aqueous solution.

The filtration rate was 0.04 $m^3.h^{-1}.m^{-2}$.

The above-indicated filtration rate could not be substantially improved, even by a massive addition of flocculating agent: 100 $cm^3$ of the above-mentioned solution of flocculating agents gave a filtration rate of 0.05 $m^3.h^{-1}.m^{-2}$.

In a second test which illustrates the good influence of the pretreatment process according to the invention, 100 g of the same bituminous sand was wetted by means of 17 kg of $OH^-$ per tonne of clay, in the form of an aqueous solution of NaOH, in a proportion of 30 g of said solution, the ratio L/S accordingly being close to 0.3. When the medium was wetted in that way, it was raised to a temperature of 40° C. and held at that temperature for 4 hours. After that period of time, the medium produced was subjected to carbonation by means of continuous injection of $CO_2$ gas, after said medium had been placed in an agitated reaction vessel, with a dilution operation which raises the ratio L/S expressed in terms of $m^3/t$ to 2.5 and at the temperature of the prior art, of 78° C. The carbonation operation was stopped when the pH-value of the suspension reached 8.6.

The operations involving extraction by means of kerosine and filtration were carried out in accordance with the procedure set forth in the first test.

After the suspension had received the addition of 20 milliliters of the above-mentioned 0.5 g/l solution of Floerger FA 10, the filtration rate on a Büchner filter is found to be very substantially improved since it was 2.9 $m^3.h^{-1}.m^{-2}$.

We claim:

1. A process for pretreatment of natural materials including at least one combustible element whose gangue comprises argillaceous compounds, comprising the steps of (a) maintaining the natural material at about atmospheric pressure, (b) bringing the natural material into intimate contact with at least one alkaline agent in a ratio of at least 4 kg of agent, calculated in terms of $OH^-$, per ton of argillaceous compounds contained in said material to form a pretreatment medium, said medium having a liquid-solid ratio of between 0.05 and 0.5, calculated in terms of cubic meters of liquid present in the medium to tons of dry natural material present in the medium, such that said medium has a physical state which varies from solid to pasty, and (c) subjecting the pretreatment medium to a pretreatment temperature of at most equal to 150° C. for at least 30 minutes, whereby said process prevents said argillaceous compounds from forming a stable plastic suspension in the presence of water.

2. A pretreatment process according to claim 1 wherein the alkaline agent is selected from the group consisting of sodium hydroxide, potassium hydroxide, ammonium hydroxide and calcium hydroxide.

3. A pretreatment process according to claim 1 wherein the alkaline agent is formed by a mixture of at least two hydroxides which are selected from the group consisting of sodium hydroxide, potassium hydroxide, ammonium hydroxide and calcium hydroxide.

4. A pretreatment process according to claim 1 wherein the alkaline agent is introduced in a solid form.

5. A pretreatment process according to claim 1 wherein the alkaline agent is introduced in the form of an aqueous suspension.

6. A pretreatment process according to claim 1 wherein the amount of alkaline agent expressed in terms of $OH^-$ is between 4 and 100 kg per ton of clay contained in the natural material.

7. A pretreatment process according to claim 6 characterised in that the amount of alkaline agent expressed in respect of $OH^-$ which is brought into intimate contact with the natural material is between 10 and 90 kg of $OH^-$ per ton of clay contained in the natural material.

8. A pretreatment process according to claim 1 wherein the liquid-solid ratio is between 0.1 and 0.4.

9. A pretreatment process according to claim 1 wherein the combustible element is coal or lignite and the pretreatment temperature is between 15° and 150° C.

10. A pretreatment process according to claim 1 wherein the combustible element is petroleum or bitumen and the pretreatment temperature is between 15° and 90°.

11. A pretreatment process according to claim 1 wherein the natural material is subjected to a drying operation prior to step (a).

* * * * *